US005348450A

United States Patent [19]

Martin et al.

[11] Patent Number: 5,348,450

[45] Date of Patent: Sep. 20, 1994

[54] BOOTSTRAP METHOD OF LOADING A COMPRESSOR HAVING A SPRING LOADED BLOWOFF VALVE

[75] Inventors: Daniel T. Martin, Clemmons; William H. Harden, III, Yadkinville, both of N.C.

[73] Assignee: Ingersoll-Rand Company, Woodcliff Lake, N.J.

[21] Appl. No.: 200,972

[22] Filed: Feb. 24, 1994

Related U.S. Application Data

[63] Continuation-in-part of Ser. No. 74,089, Jun. 9, 1993, abandoned.

[51] Int. Cl.[5] ..... F04B 49/00

[52] U.S. Cl. ..... 417/299; 417/308

[58] Field of Search ..... 417/290, 299, 307, 308, 417/302, 303; 137/492

[56] References Cited

U.S. PATENT DOCUMENTS

| | | | |
|---|---|---|---|
| 2,362,724 | 11/1944 | Shea . | |
| 2,469,224 | 5/1949 | Caine . | |
| 3,007,492 | 11/1961 | Grimmer | 137/492 |
| 3,692,038 | 9/1972 | Hansen et al. . | |
| 3,871,397 | 3/1975 | Larsen . | |
| 4,406,589 | 9/1983 | Tshchica et al. . | |
| 4,729,721 | 3/1988 | Hansen et al. . | |
| 5,081,839 | 1/1992 | McWilliams . | |
| 5,156,177 | 10/1992 | Bishoff . | |
| 5,242,277 | 9/1993 | Bartlett . | |

FOREIGN PATENT DOCUMENTS

| | | | |
|---|---|---|---|
| 0005580 | 1/1982 | Japan | 417/307 |

*Primary Examiner*—Richard A. Bertsch
*Assistant Examiner*—Michael I. Kocharov
*Attorney, Agent, or Firm*—Victor M. Genco, Jr.

[57] ABSTRACT

An apparatus for loading a compressor includes a microprocessor based electronic controller, a pneumatically driven, spring loaded open first valve, and a normally open, electrically driven second valve flow connected in series with the first valve. The first valve and the second valve are fluidly disposed intermediate a receiver tank and the compressor. The second valve is disposed in signal receiving relation to the controller. An orifice and muffler combination is flow connected intermediate the first valve and the second valve. The orifice has a predetermined inside diameter dimension suitably sized to establish a pressure signal to close the first valve to thereby load the compressor. During operation, at a predetermined time, the controller closes the second valve thereby directing a predetermined volume of fluid to be compressed through the orifice and muffler combination to cause fluid pressure to rise to a predetermined magnitude, at which time sufficient actuation pressure is available for control of the spring loaded first valve.

4 Claims, 1 Drawing Sheet

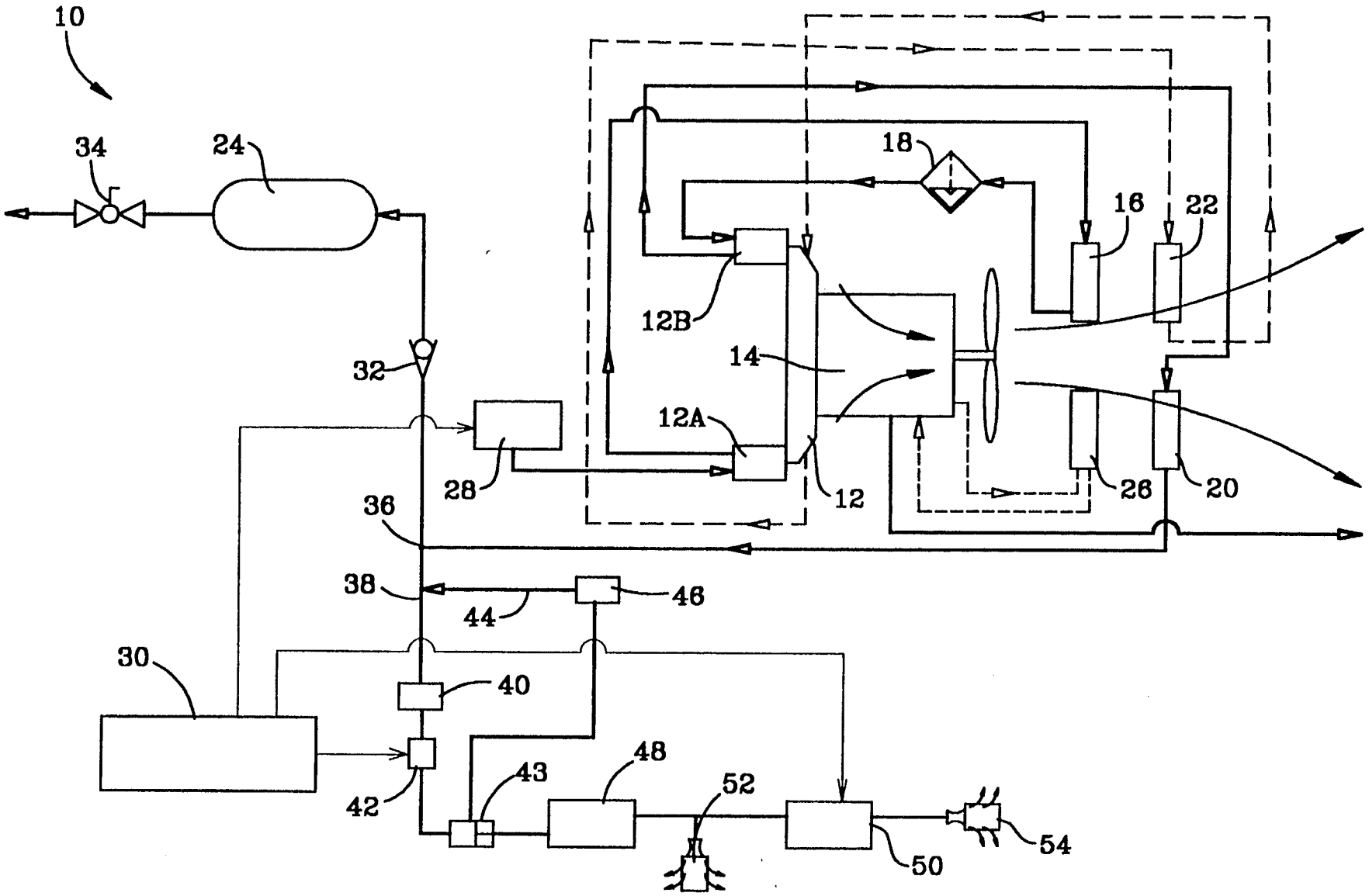
10
34
24
32
28
12B
12A
14
12
18
16
22
20
28
36
38
44
46
40
42
30
43
48
52
50
54

BOOTSTRAP METHOD OF LOADING A COMPRESSOR HAVING A SPRING LOADED BLOWOFF VALVE

This is a continuation-in-part application of application Ser. No. 08/074,089 filed on Jun. 9, 1993 now abandoned.

BACKGROUND OF THE INVENTION

This invention generally relates to compressors, and more particularly to a bootstrap method of loading a compressor having a blowoff valve which is spring loaded in a valve open position.

It is often necessary to unload or to de-pressurize a compressed air system, such as during periodic maintenance or during compressor shutdown. One method of unloading or de-pressurizing a compressed air system is by way of a blowoff valve. A type of blowoff valve, which typically is fail-safe during its operation in a compressor or a compressed air system, incorporates a design wherein a pneumatically controlled blowoff valve is spring loaded in a valve open position. A drawback associated with this type of blowoff valve design is that it must be pneumatically actuated to a closed position upon initial compressor start-up, however, at compressor start-up, typically there is insufficient compressed air pressure to pneumatically actuate the blowoff valve to the closed position.

Presently, in compressed air systems which employ these type of pneumatically controlled blowoff valves, at initial compressor start-up, these valves are actuated to a closed position by externally supplied compressed air, such as by plant or facility supplied compressed air. However, in a remote location, externally supplied compressed air typically is not available. Accordingly, despite the laudable fail-safe benefits of employing these types of blowoff valves, they are not useful in compressors which are employed in remote areas because there has not been an available method to pneumatically close these valves upon initial compressor start-up.

The foregoing illustrates limitations known to exist in present portable compressors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus having a microprocessor based electronic controller; a first, pneumatically driven, spring loaded open valve; and a second, electrically driven valve flow connected in series with the first valve. The second valve is disposed in signal receiving relation to the controller. An orifice means restricts the flow of a compressible fluid to produce a predetermined pressure signal. The orifice means has a predetermined inside diameter dimension suitably sized to produce a pressure signal of sufficient magnitude to close the first valve, at a predetermined time, to thereby load the compressor.

The foregoing and other aspects will become apparent from the following detailed description of the invention when considered in conjunction with the accompanying drawing figure.

BRIEF DESCRIPTION OF THE DRAWING FIGURE

The FIGURE is a functional block diagram representation of a compressed air system, according to the present invention, which includes a bootstrap method of loading a compressor having a blowoff valve which is spring loaded to a valve open position.

DETAILED DESCRIPTION

The Figure is a functional block diagram representation of compressed air system 10 having the following major system components: a two stage centrifugal compressor or airend 12, having a first stage 12A and a second stage 12B; a prime mover 14, such as, but not limited to, a diesel engine; an intercooler 16; a water separator 18; an aftercooler 20; an oil cooler 22; a receiver tank 24; and an engine radiator 26. Although a two-stage centrifugal compressor or airend 12 is described herein, it is anticipated that the teachings of the present invention may apply equally to compressed air systems having one stage or more than two stages, as well.

The two stage centrifugal compressor 12 is driven by the diesel engine 14. Compressor intake air flows through an inlet duct (not shown) to an inlet control valve 28, which in the preferred embodiment is a butterfly type valve. The inlet control valve 28 is directly mounted on the airend first stage, as is well known in the art. The inlet control valve 28 is used for pressure and capacity control and is controlled by a microprocessor based electronic controller 30.

Air entering the first stage 12A of the airend 12 is compressed to an intermediate predetermined pressure of approximately 35 PSIG. The air exits the first stage and flows through an interstage duct (not shown) to the intercooler 16 for cooling prior to entering the second stage 12B for final compression. Cooled and saturated interstage air then leaves the intercooler 16 and flows through the water separator 18 to the airend 12 for second stage compression.

Interstage air is compressed by the second stage 12B to a pressure equal to 3–4 PSI above a predetermined receiver tank pressure. The second stage compressed air exits the second stage 12B and flows through the aftersstage discharge duct (not shown) to the aftercooler 20 for final cooling, and through a spring loaded wafer-style check valve 32 to the inlet of the receiver tank 24. Compressed air is discharged from the compressed air system through a service valve 34.

At a predetermined fluid point 36, compressed air is separately directed to a first compressed air branch 38 which contains a pressure regulator 40, an I/P transducer 42 (current-to-pressure converter), and a blowoff valve positioner/actuator 43; and to a second compressed air branch 44 which includes a pressure regulator 46, blowoff valve positioner/actuator 43, and a blowoff valve 48. The compressed air flow paths 38 and 44 provide a means for controlling internal air blowoff from fluid point 37 when the service valve 34 is closed during compressor operation, and also permit initial pressure loading via a bootstrap method as will be explained hereinafter.

In the first compressed air branch 38, compressed air flows through a pressure regulator 40 which reduces the pressure of the compressed air to 25 PSIG. The I/P transducer 42 is disposed in fluid communication with the source of 25 PSIG compressed air. As illustrated by the Figure, the I/P transducer 42 is disposed in electronic signal receiving relation to the electronic controller 30, and in pneumatic signal transmitting relation to the blow off valve positioner/actuator 43. The electronic controller 30 is operable to supply the I/P transducer 42 with a current signal ranging between 4 and 20 milliamps. The I/P transducer 42 is operable to provide the blowoff valve positioner/actuator 43 with a 3–15 PSIG pneumatic signal which is linear with respect to the 4–20 milliamp current signal to thereby control the positioning of the blowoff valve 48 during compressor operation.

In the second compressed air branch, compressed air flows from the fluid point 36 through the pressure regulator 46 which reduces the pressure of the compressed air to 80 PSIG. The 80 PSIG compressed air is then supplied to the blowoff valve positioner/actuator 43 to control operation of the blowoff valve 48 in response to the 3–15 PSIG signal air supplied from the I/P transducer 42.

The blowoff valve 48 is a pneumatically operated, butterfly type valve which is flow connected in series from a predetermined fluid point 37 to an electrically driven loader valve 50. The blowoff valve 48 is spring loaded in a valve open position, and is actuated by the positioner/actuator 43. As explained hereinabove, the positioner/actuator 43 receives two sources of air, a signal air pressure ranging between 3–15 PSI and a source of motive air at 80 PSI. The positioner/actuator 43 puts motive air of a varying pressure to a predetermined side of a blowoff valve actuator piston (not shown) as dictated by the value of the 3–15 PSI signal. The blowoff valve 48 is modulated by pneumatic action, as directed by the electronic controller 30 through the I/P transducer 42.

The loader valve 50 is a butter ball type valve which is driven by an electric driver, such as a 24 volt DC motor. The loader valve is normally in a open position unless directed to close by the electronic controller 30. Flow connected intermediate the blowoff valve 48 and the loader valve 50 is a loader orifice/muffler combination 52 which includes an orifice having a critically sized inside diameter of approximately 1.0″ Downstream of the loader valve 50 is a main discharge orifice/muffler combination 54.

In operation and at initial compressor start-up, the service valve 34 is disposed in a closed position and all air flow is from a predetermined fluid point 37 through the blowoff valve 48, which is spring loaded in a valve open position. Additionally, the loader valve 50 is open, and therefore, a predetermined volume of air flows through the loader orifice/muffler combination 52 and a predetermined volume of air flows through the main discharge orifice/muffler combination 54. At a predetermined time, the controller 30 causes the compressor 12 to load, and the diesel engine 14 to accelerate to a predetermined speed. Simultaneously, the controller 30 opens the inlet control valve 28 and closes the loader valve 50. With the loader valve 50 closed, all air must flow through the loader orifice/muffler combination 52, which includes the critically sized orifice having the 1.0″ inside diameter. This 1.0″ inside diameter is a suitable dimension to cause the system pressure to rise to a predetermined value of about 60 to 80 PSIG, at which time sufficient actuation pressure is available for control of the spring loaded blowoff valve 48. The controller 30 then closes in the blowoff valve 48 to achieve a preselected discharge pressure. At a pressure of approximately 95 PSIG, the loader valve 50 is reopened as the blowoff valve 48 is closed.

While this invention has been illustrated and described in accordance with a preferred embodiment, it is recognized that: variations and changes may be made therein without departing from the invention as set forth in the following claims.

Having described the invention, what is claimed is:

1. An apparatus for loading a compressor, the apparatus comprising:

a microprocessor based electronic controller;

a first, pneumatically driven, spring loaded open valve;

a second, electrically driven valve flow connected in series with the first valve, and disposed in signal receiving relation to the controller; and an orifice means, flow connected intermediate the first pneumatically driven spring loaded open valve and the second electrically driven valve, for restricting the flow of a compressible fluid to produce a predetermined pressure signal, the orifice means having a predetermined inside diameter dimension suitably sized to produce a pressure signal of sufficient magnitude to close the first valve, at a predetermined time, to thereby load the compressor.

2. An apparatus, as claimed in claim 1, and wherein the orifice means is an orifice and muffler combination.

3. A method of loading a compressor having a spring loaded open first valve, the method comprising the steps of:

consecutively directing a predetermined volume of compressible fluid through the first valve, an orifice means for restricting the flow of a compressible fluid to produce a predetermined pressure signal, and a second electrically driven valve flow connected in series with the first valve;

accelerating a prime mover to a predetermined speed;

electrically closing the second valve; and directing the predetermined volume of compressible fluid through the orifice means to create a suitable pressure motive force to close the first valve to thereby permit the compressor to load to a predetermined pressure.

4. In a compressed air system, an apparatus for loading a compressor, the apparatus comprising:

a microprocessor based electronic controller;

a pneumatically driven, spring loaded open first valve;

a normally open, electrically driven second valve flow connected in series with the first valve, the first valve and the second valve being fluidly disposed intermediate a receiver tank and the compressor, and the second valve being disposed in signal receiving relation to the controller; and an orifice and muffler combination flow connected intermediate the first valve and the second valve, the orifice having a predetermined inside diameter dimension suitably sized to produce a pressure signal having a predetermined magnitude, and during operation, at a predetermined time, the controller closes the second valve thereby directing a predetermined volume of a compressible fluid through the orifice and muffler combination to cause fluid pressure to rise to a predetermined magnitude, at which time sufficient actuation pressure is available for control of the spring loaded first valve.

* * * * *